US007831161B2

(12) United States Patent
Hirayama et al.

(10) Patent No.: US 7,831,161 B2
(45) Date of Patent: Nov. 9, 2010

(54) METHOD AND APPARATUS FOR IMAGE FORMING OF EFFECTIVELY DETECTING IMAGE DATA

(75) Inventors: Yuushi Hirayama, Sagamihara (JP); Mitsuru Takahashi, Kawasaki (JP); Kazuosa Kuma, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 906 days.

(21) Appl. No.: 11/589,862

(22) Filed: Oct. 31, 2006

(65) Prior Publication Data

US 2007/0098423 A1 May 3, 2007

(30) Foreign Application Priority Data

Oct. 31, 2005 (JP) ..... 2005-317380

(51) Int. Cl.
*G03G 15/00* (2006.01)

(52) U.S. Cl. ..... 399/49; 399/299; 399/300; 399/302; 399/306

(58) Field of Classification Search ..... 399/49, 399/299, 300, 302, 306
See application file for complete search history.

(56) References Cited

U.S. PATENT DOCUMENTS

2003/0206749 A1* 11/2003 Kashiwabara et al. ..... 399/302
2005/0105927 A1* 5/2005 Kayahara ..... 399/49
2007/0053727 A1* 3/2007 Goto ..... 399/301
2008/0124107 A1 5/2008 Takeuchi et al.

FOREIGN PATENT DOCUMENTS

| | | |
|---|---|---|
| JP | 10-161388 | 6/1998 |
| JP | 11-218994 | 8/1999 |
| JP | 2000-025975 | 1/2000 |
| JP | 2002-040722 | 2/2002 |
| JP | 2002-072574 | 3/2002 |
| JP | 2002-123052 | 4/2002 |
| JP | 2003-167394 | 6/2003 |
| JP | 2004-326085 | 11/2004 |

* cited by examiner

*Primary Examiner*—Ryan D Walsh
(74) *Attorney, Agent, or Firm*—Oblon, Spivak, McClelland, Maier & Neustadt, L.L.P.

(57) ABSTRACT

An image forming apparatus and corresponding method, the image forming apparatus including a belt member supported by at least two rollers, an image forming member configured to form a patch pattern of image data on a surface of the belt member, a belt supporting member configured to support the belt member on a contact area thereof with respect to the belt member at a position higher than a tangent line of the at least two rollers, and a sensor configured to detect the patch pattern formed on the surface of the belt member at the contact area of the belt supporting member and the belt member.

21 Claims, 8 Drawing Sheets

METHOD AND APPARATUS FOR IMAGE FORMING OF EFFECTIVELY DETECTING IMAGE DATA

CROSS REFERENCE TO RELATED APPLICATIONS

The present application claims priority to Japanese patent application no. 2005-317380, filed in the Japan Patent Office on Oct. 31, 2005, the disclosure of which is incorporated by reference herein in its entirety.

BACKGROUND OF THE INVENTION

1. Field of the Invention

The present invention relates to a method and apparatus for image forming of effectively detecting image data on a belt member. More particularly, the present invention relates to an image forming apparatus for detecting a patch pattern formed on a belt member and a method of detecting image data while keeping an appropriate focal length of a sensor for detecting the patch pattern.

2. Discussion of the Related Art

An image forming apparatus forms a visible image on an image bearing member and transfers the visible image onto a transfer member. The transfer member includes a sheet-like recording medium contacting the surface of the image bearing member for directly receiving a multiple color image, a belt-shaped member for receiving and carrying a multiple color image on a surface thereof as an intermediate transfer member, and so forth.

In a background color image forming apparatus, a plurality of image bearing members, which form and carry respective images corresponding to respective colors obtained after color separation and a belt member that serves as an intermediate transfer member or as a sheet carrying member, are disposed opposite to the plurality of image bearing members.

In a case where the belt member is mounted as an intermediate transfer member, the color image forming apparatus performs a primary transfer process for sequentially transferring and overlaying the respective separated color images formed on the plurality of image bearing members onto the intermediate transfer member and a secondary transfer process for transferring the overlaid color image onto a recording medium or recording sheet.

In a case where the belt member is mounted as a sheet carrying member, the color image forming apparatus causes the respective images formed on the plurality of image bearing members to be overlaid on the recording sheet while the recording sheet is carried by the sheet carrying member and conveyed between the sheet carrying member and the plurality of image bearing members disposed to face the recording sheet.

For accurately forming a color image with the above-described image forming operations, it is required that a color image forming apparatus obtain stable image forming qualities including color reproducibility without color shift, density nonuniformity, and so forth.

To achieve the above-described stable image qualities, a density detecting patch pattern image or a patch pattern may be used as corresponding image data.

The image forming apparatus forms a patch pattern, which includes a density detecting pattern, on an image bearing member or an intermediate transfer belt carrying a visible image transferred from the image bearing member. The patch pattern is optically scanned, and the color image forming apparatus feeds back the scanned result to control various parameters used for image forming conditions.

The feed back control in this case causes an image density detection sensor to measure an adhesion amount of toner on a patch pattern on the intermediate transfer belt. When the measurement result does not meet a predetermined condition, the feed back control is performed so that the various parameters can meet the predetermined condition. The various parameters include the write and read characteristics, the charging characteristic of the image bearing member, the charging characteristic for adhesive property of toner in the developer, the development bias characteristic that controls an amount of adhered toner, and so forth.

The patch pattern having a size larger than a detectable range of the image density detection sensor is formed on the intermediate transfer belt. The measurement of the patch pattern is performed with respect to the portion in which the output result from the density detection sensor is saturated, that is, the portion in which the patch pattern is formed in the entire detectable range of the image density detection sensor. Based on the detection result, the amount of adhered toner on the patch pattern is calculated. The calculated amount of adhered toner on the patch pattern is used to determine a predetermined density.

The patch pattern has a constant density and is formed outside the regular image forming area of a color toner image. Specifically, the patch pattern is formed between toner images of the regular image forming operation and has a predetermined distance from the leading edge of the next toner image so that the patch pattern does not overlap with the next toner image. When the density of the patch pattern is detected, a secondary transfer unit may be separated from the intermediate transfer belt.

Further, when detecting the density of a patch pattern, an optical sensor that is disposed opposite to a tensioned area of the intermediate transfer belt is used.

For a sensor used for detecting a patch pattern formed on a belt member, a reflective light sensor is commonly used because the reflective light sensor has an advantage in detecting the amount of reflected light according to the density of a patch pattern.

The reflective light sensor needs to maintain an accurate focal length with respect to a target material. When the focal length is not accurate, the sensor characteristic may change to deteriorate the detection accuracy, which may exert an adverse affect on the image forming control. Therefore, when the reflective light sensor detects the density of a target material, the focal length needs to be properly set or adjusted.

Further, vibration that may occur to a belt member while the belt member is moving may cause changes in image density and color registration. Vibration may occur while a belt member carrying a patch pattern to be detected is moving or the sensor output results obtained by a reflective light sensor may vary due to the surface characteristic of the belt member. Such vibration of the belt member or variation of the sensor output results can induce an unstable image density control and an unstable color shift control.

To eliminate the above-described problems, background image forming apparatuses have employed various techniques or methods as follows:

Method 1. A reflective light sensor detects patch patterns on a belt member moving on a suspension roller to which a smaller degree of belt vibration may be produced;

Method 2. A reflective light sensor detects patch patterns in an area on which the normal direction of a belt member crosses a suspension roller; and Method 3. A reflective light sensor detects patch patterns on a rotatable supporting member that is disposed between suspension rollers.

When Method 1 is employed, the belt member serving as an intermediate transfer belt may produce less vibration of the sensor output results. Method 1 may, however, cause a sharp peak in predetermined intervals of the sensor output results when a foreign material gets caught between the intermediate transfer belt and the suspension roller.

Further, when the suspension roller is not sufficiently arranged in parallel or in a horizontal direction, the suspension roller may become eccentric when rotated, which can cause the sensor output results to vary in a rotation cycle of the suspension roller.

Aside from the variation of the sensor output results, when the diameter of the suspension roller is relatively small, a small degree of displacement of the sensor may change the distance of the detection surface of the intermediate transfer belt and the sensor to separate far apart, which can cause an adverse affect on a distance characteristic of the sensor.

When Method 2 is employed, no objects are caught under the intermediate transfer belt, and the surface of the intermediate transfer belt can be maintained in a relatively flat manner. Further, since the suspension roller is disposed in the vicinity of the target location, the amount of belt vibration in a vertical direction can be reduced.

However, if a slippage prevention guide, which is a rail-shaped guide for one cycle of the belt, is disposed at the back side or inner surface of the belt, the belt may be vibrated when the seam or boundary gap of the slippage prevention guide passes the suspension roller, and the sharp peak may be generated in every belt cycle.

Method 3 can provide a constant focal length of the intermediate transfer belt and the reflective light sensor.

However, similar to Method 1, when the rotatable supporting member is not sufficiently arranged in parallel or in a horizontally direction, the rotatable supporting member may become eccentric when rotated, which can cause the sensor output results to vary in a rotation cycle of the supporting member.

SUMMARY OF THE INVENTION

Exemplary aspects of the present invention have been made in view of the above-described circumstances.

Exemplary aspects of the present invention provide a novel image forming apparatus that can effectively detect image data.

Other exemplary aspects of the present invention provide a novel method of detecting image data with an appropriate focal length of a sensor of the above-described novel image forming apparatus.

In one exemplary embodiment, a novel image forming apparatus includes a belt member supported by at least two rollers, an image forming member configured to form a patch pattern of image data on a surface of the belt member, a belt supporting member configured to support the belt member on a contact area thereof with respect to the belt member at a position higher than a tangent line of the at least two rollers, and a sensor configured to detect the patch pattern formed on the surface of the belt member at the contact area of the belt supporting member and the belt member.

The belt supporting member may be formed in one of a planar shape and a substantially planar shape with a gentle curl.

The belt supporting member may be formed in one of a planar shape and a substantially planar shape with a gentle curl and includes at least one rectangular contact surface in a belt width direction.

The at least one rectangular contact surface may be disposed at a position facing the sensor.

The belt supporting member may include a brush on a surface thereof.

The belt supporting member may be arranged to tilt to a downstream side thereof in an upward direction such that a difference between an approach angle of the belt member with respect to the belt supporting member and a tilt angle of the belt supporting member falls in a range of angle from approximately 0.5 degrees to approximately 10 degrees, based on the surface of the belt member as a reference surface.

The sensor may have a mounting angle to be adjusted according to the tilt angle of the belt supporting member.

Further, in one exemplary embodiment, a novel method of detecting image data with an appropriate focal length of a sensor of an image forming apparatus includes supporting a belt member with at least two rollers in a tensioned manner, mounting a belt supporting member on a contact area with respect to the belt member at a position higher than a tangent line of the at least two rollers, and detecting a patch pattern formed on the belt member at the contact area of the belt supporting member and the belt member.

The above-described novel method may include tilting the belt supporting member to a downstream side thereof in an upward direction such that a difference between an approach angle of the belt member with respect to the belt supporting member and a tilt angle of the belt supporting member falls in a range of angle from approximately 0.5 degrees to approximately 10 degrees, based on the surface of the belt member as a reference surface.

The above-described novel method may include adjusting a mounting angle of the sensor according to the tilt angle of the belt supporting member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
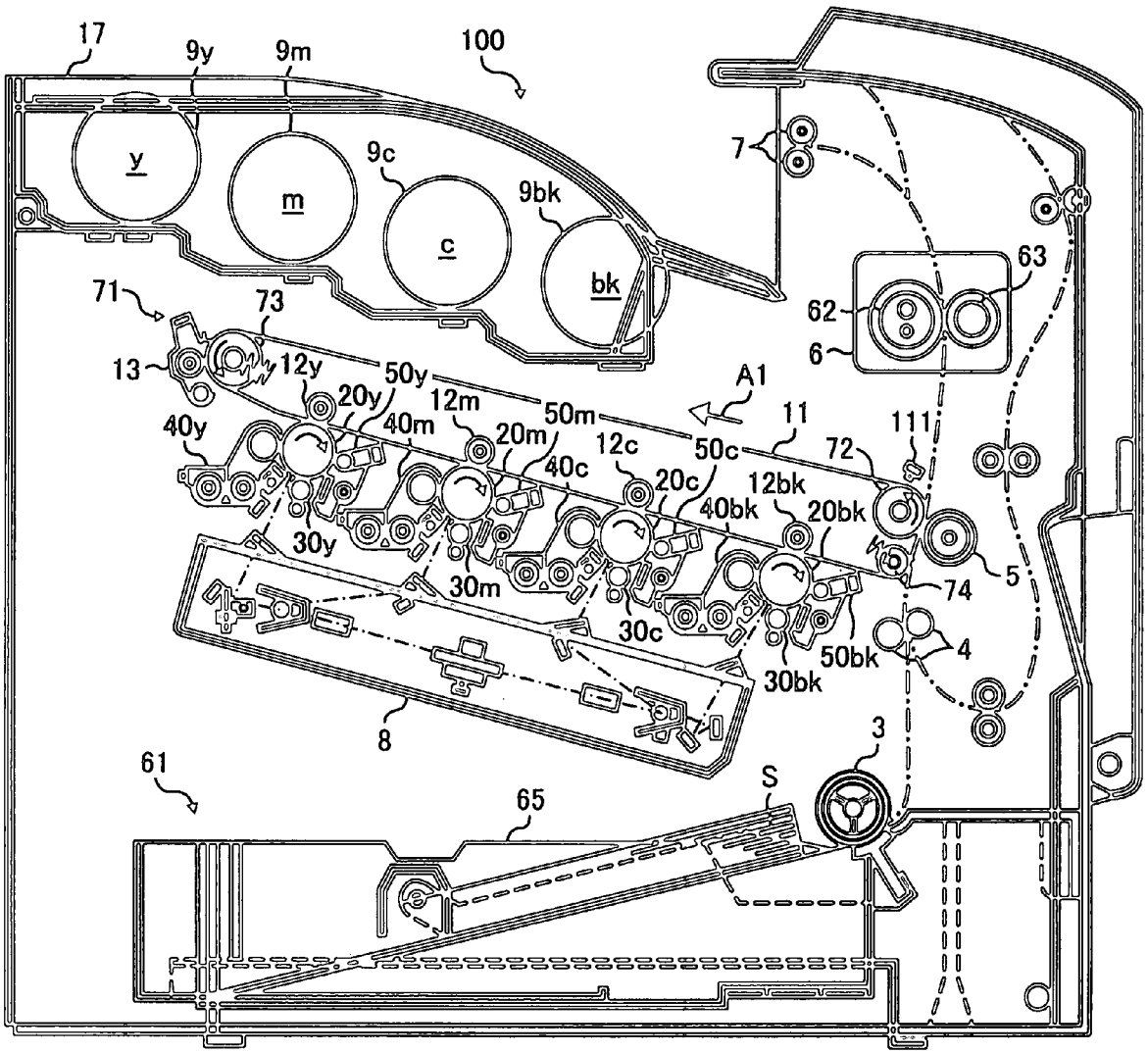
FIG. 1 is a schematic structure of an image forming apparatus according to one exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the. present invention are described.

Figure 2:
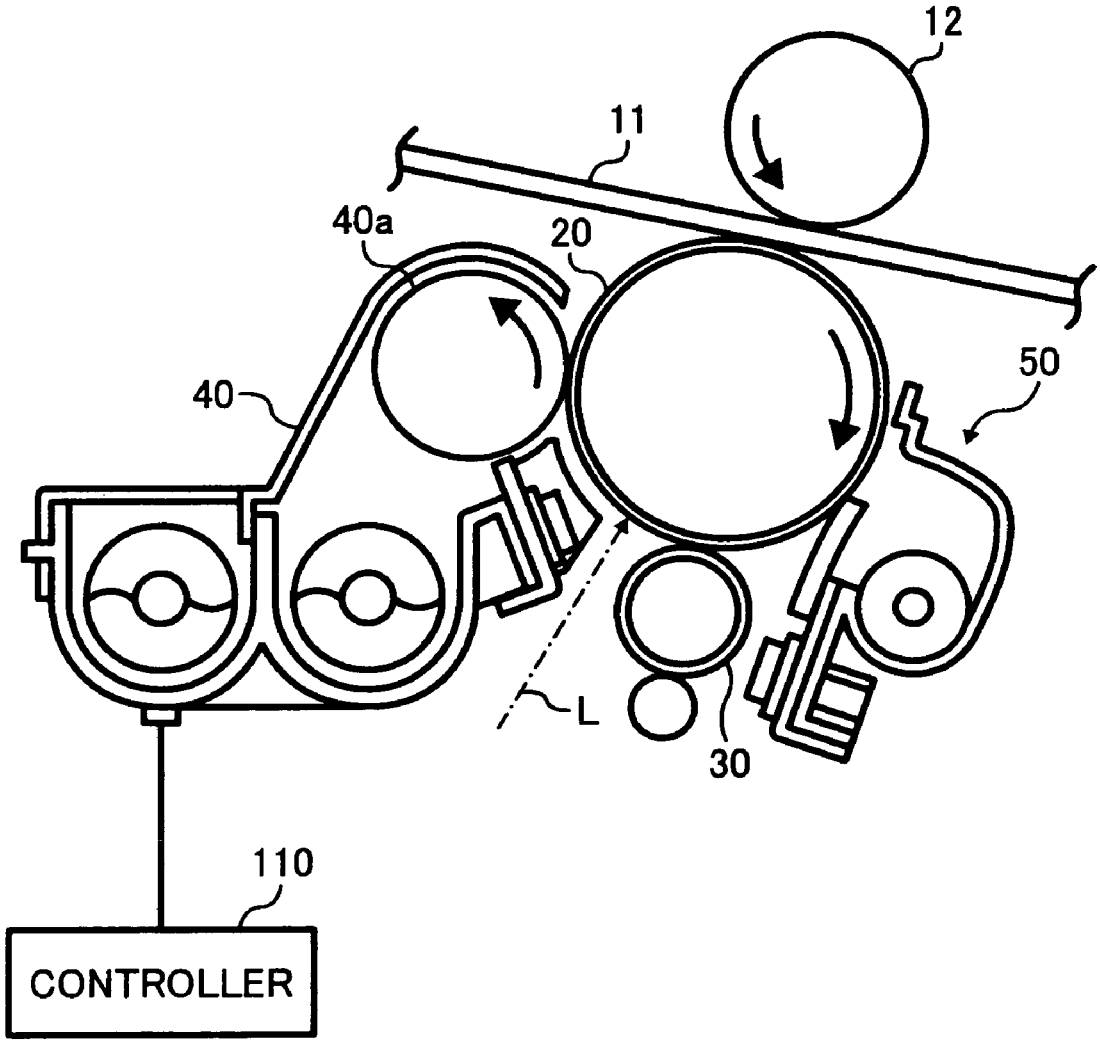
FIG. 2 is a schematic structure of a process cartridge provided in the image forming apparatus of FIG. 1.

Referring to FIGS. 1 and 2, a schematic structure of an image forming apparatus 100 according to one exemplary embodiment of the present invention is described. FIG. 1 depicts a structure of an entire system of the image forming apparatus 100, and FIG. 2 depicts a detailed structure of image forming components used for forming a single color toner image.

The image forming apparatus 100 in FIG. 1, in which an image data detection method is employed, is a laser printer in which a plurality of image forming operations can be performed. However, the image forming apparatus 100 is not limited to a laser printer, but can be applied as a copier, facsimile machine, printing press, and so forth. Further, the image forming apparatus 100 can be applied as a multifunctional machine having at least two functions in combination of a copier, printer, facsimile machine, printing press, and so forth.

The image forming apparatus 100 in FIG. 1 employs a tandem structure and generally includes a plurality of photoconductive drums 20*y*, 20*m*, 20*c*, and 20*bk*, a transfer device 71, an optical writing unit 8, a sheet feeding device 61, a plurality of toner bottles 9*y*, 9*m*, 9*c*, and 9*bk*, and a fixing device 6.

The image forming apparatus 100 includes four image forming stations for performing image forming operations of each color. The plurality of photoconductive drums 20*y*, 20*m*, 20*c*, and 20*bk* are included in the respective image forming stations and are arranged in an oblique manner in this order from the upstream side of the intermediate transfer belt 11 in the direction A1. Each of the plurality of photoconductive drums 20*y*, 20*m*, 20*c*, and 20*bk* serves as an image bearing member. The plurality of photoconductive drums 20*y*, 20*m*, 20*c*, and 20*bk* form respective toner images corresponding to image data of single colors after color separation, for example, yellow, magenta, cyan, and black.

The image forming stations of the image forming apparatus 100 includes other image forming components, such as charging units 30*y*, 30*m*, 30*c*, and 30*bk*, developing units 40*y*, 40*m*, 40*c*, and 40*bk*, and cleaning units 50*y*, 50*m*, 50*c*, and 50*bk*. These image forming components are described in detail later.

In the image forming apparatus 100 of FIG. 1, respective toner images formed on the photoconductive drums 20*y*, 20*m*, 20*c*, and 20*bk* are sequentially transferred onto a surface of an intermediate transfer member or intermediate transfer belt 11 in a form of an endless belt. The intermediate transfer belt 11 rotates in a direction indicated by arrow A1 in FIG. 1 and receives an overlaid color toner image. The above-described transfer operation is referred to as a "primary transfer operation."

The overlaid color toner image on the surface of the intermediate transfer belt 11 is then transferred onto a transfer sheet S, which serves as a recording medium, at a secondary transfer nip. The above-described transfer operation is referred to as a "secondary transfer operation."

In FIG. 2, a detailed structure of one of the image forming stations is described.

Since the above-described components indicated by "y", "m", "c", and "bk" used for the image forming operations have similar structures and functions, except that respective toner images formed thereon are of different colors, which are yellow, magenta, cyan, and black toners, the discussion in FIG. 2 uses reference numerals for specifying components of the image forming apparatus 100 without the suffixes.

As shown in FIG. 2, the image forming components are disposed around the photoconductive drum 20. That is, the charging unit 30, the developing unit 40, the primary transfer roller 12, and the cleaning unit 50 are arranged in the order of image forming operations along the direction of rotation of the photoconductive drum 20.

The charging unit 30 uniformly charges a surface of the photoconductive drum 20.

The developing unit 40 includes a developing sleeve 40*a* and develops the electrostatic latent image formed on the surface of the photoconductive drum 20 into a visible toner image.

The cleaning unit 50 removes residual toner remaining on the surface of the photoconductive drum 20 after the toner image has been transferred onto the surface of the intermediate transfer belt 11.

A discharging unit (not shown) is also disposed in the vicinity of the photoconductive drum 20 for discharging residual charge from the surface of the photoconductive drum 20 after the cleaning unit 50 removes residual toner therefrom.

As shown in FIG. 2, the photoconductive drum 20, the charging unit 30, the developing unit 40, and the cleaning unit 50 can be integrally mounted in a process cartridge that can form an image forming station. The process cartridge may be detachable with respect to the image forming apparatus 100 so that the consumable parts can easily be replaced.

In the image forming apparatus 100 of FIG. 1, the optical writing unit 8 is used for forming an electrostatic latent image on the surface of the photoconductive drum 20 after the charging unit 30 uniformly charges the surface thereof.

The optical writing device 8 is disposed below the image forming stations. The optical writing device 8 includes a semiconductor laser (not shown) serving as a light source, a coupling lens (not shown), an f-theta lens (not shown), a troidal lens (not shown), mirrors (not shown), a polygon mirror (not shown) and so forth.

The optical writing device 8 emits respective laser light beams L (see FIG. 2) to irradiate respective surfaces of the photoconductive drums 20*y*, 20*m*, 20*c*, and 20*bk* so that respective laser electrostatic latent images are formed on the respective surfaces of the photoconductive drums 20*y*, 20*m*, 20*c*, and 20*bk*.

The transfer device 71 includes a transfer belt unit 10, a plurality of primary transfer rollers 12*y*, 12*m*, 12*c*, and 12*bk*, a secondary transfer roller 5, and a cleaning unit 13.

The transfer belt unit 10 is disposed opposite to the four image forming stations, facing respective upper portions of the photoconductive drums 20*y*, 20*m*, 20*c*, and 20*bk*. The transfer belt unit 10 includes the intermediate transfer belt 11 facing the plurality of primary transfer rollers 12*y*, 12*m*, 12*c*, and 12*bk*.

As previously described, the respective toner images formed on the photoconductive drums 20*y*, 20*m*, 20*c*, and 20*bk* are sequentially transferred onto the surface of the intermediate transfer belt 11 as an overlaid color toner image while the intermediate transfer belt 11 is moving in the direction A1. The movement of the intermediate transfer belt 11 is controlled to receive the respective toner images to overlay at the same position on the surface of the intermediate transfer belt 11. Specifically, the primary transfer rollers 12*y*, 12*m*, 12*c*, and 12*bk* are arranged opposite to the photoconductive drums 20*y*, 20*m*, 20*c*, and 20*bk*, respectively, and apply voltage to the photoconductive drums 20*y*, 20*m*, 20*c*, and 20*bk* at respective predetermined staggered timings in the direction A1.

The intermediate transfer belt 11 is extendedly supported by or is spanned around a secondary backup roller 72, a cleaning backup roller 73, and a tension roller 74.

The backup roller 72 is held in contact with the secondary transfer roller 5, sandwiching the intermediate transfer belt 11, to form a secondary transfer nip.

The cleaning backup roller 73 and tension roller 74 serve as tension biasing members with respect to the intermediate transfer belt 11 and include biasing members such as springs.

The secondary transfer roller 5 is disposed opposite to the secondary transfer backup roller 72, sandwiching the intermediate transfer belt 11. The secondary transfer roller 5 serves as a secondary transfer unit and is rotated following the rotations of the intermediate transfer belt 11.

The intermediate transfer belt cleaning unit 13 is disposed opposite to the cleaning backup roller 73, sandwiching the intermediate transfer roller 11. The intermediate transfer belt cleaning unit 13 removes residual toner from the surface of the intermediate transfer belt 11.

The intermediate transfer belt cleaning unit 13 includes a cleaning brush (not shown) and a cleaning blade (not shown) arranged to face and contact the intermediate transfer belt 11. The intermediate transfer belt cleaning unit 13 scrapes and removes residual toner and other foreign materials remaining on the surface of the intermediate transfer belt 11. The intermediate transfer belt cleaning unit 13 further includes a toner discharging unit (not shown) to convey and discharge residual toner removed from the intermediate transfer belt 11.

The sheet feeding device 61 is disposed at the lower portion of the image forming apparatus 100.

The sheet feeding device 61 includes a sheet feeding cassette 65, a sheet feeding roller 3, a pair of registration rollers 4, and a sheet conveyance sensor (not shown).

The sheet feeding cassette 65 accommodates transfer sheets as recording media.

The sheet feeding roller 3 is held in contact with a transfer sheet S placed on the top of a sheet stack of recording media accommodated in the sheet feeding cassette 65. By rotating the sheet feeding roller 3 in the counterclockwise direction, the transfer sheet S is fed toward the pair of registration rollers 4.

The pair of registration rollers 4 forwards the transfer sheet S conveyed from the sheet feeding device 61 in synchronization with a movement of the intermediate transfer belt 11 so that the toner image is formed on the surface of the intermediate transfer belt 11.

The sheet conveyance sensor (not shown) detects that the leading edge of the transfer sheet S has reached the pair of registration rollers 4.

The fixing device 6 employs a heat roller fixing method in which a toner image formed on the surface of the transfer sheet S is fixed to the transfer sheet S by applying heat and pressure.

The fixing device 6 includes a fixing roller 62 and a pressure roller 63. The fixing roller 62 includes a heat source therein and the pressure roller 63 presses contact with the fixing roller 62. When the transfer sheet S having a toner image on the surface thereof passes between the fixing roller 62 and the pressure roller 63 while the fixing device 6 is applying heat and pressure, the full color toner image formed on the transfer sheet S is fixed onto the surface of the transfer sheet S.

The sheet discharging roller 7 discharges the transfer sheet S having the fixed toner image thereon to a sheet discharging tray 17.

The plurality of toner bottles 9*y*, 9*m*, 9*c*, and 9*bk* are disposed below the sheet discharging tray 17 and contain yellow, magenta, cyan, and black toners, respectively.

The image forming apparatus 100 further includes a reflective light photosensor 111, which will be described later.

Figure 3:
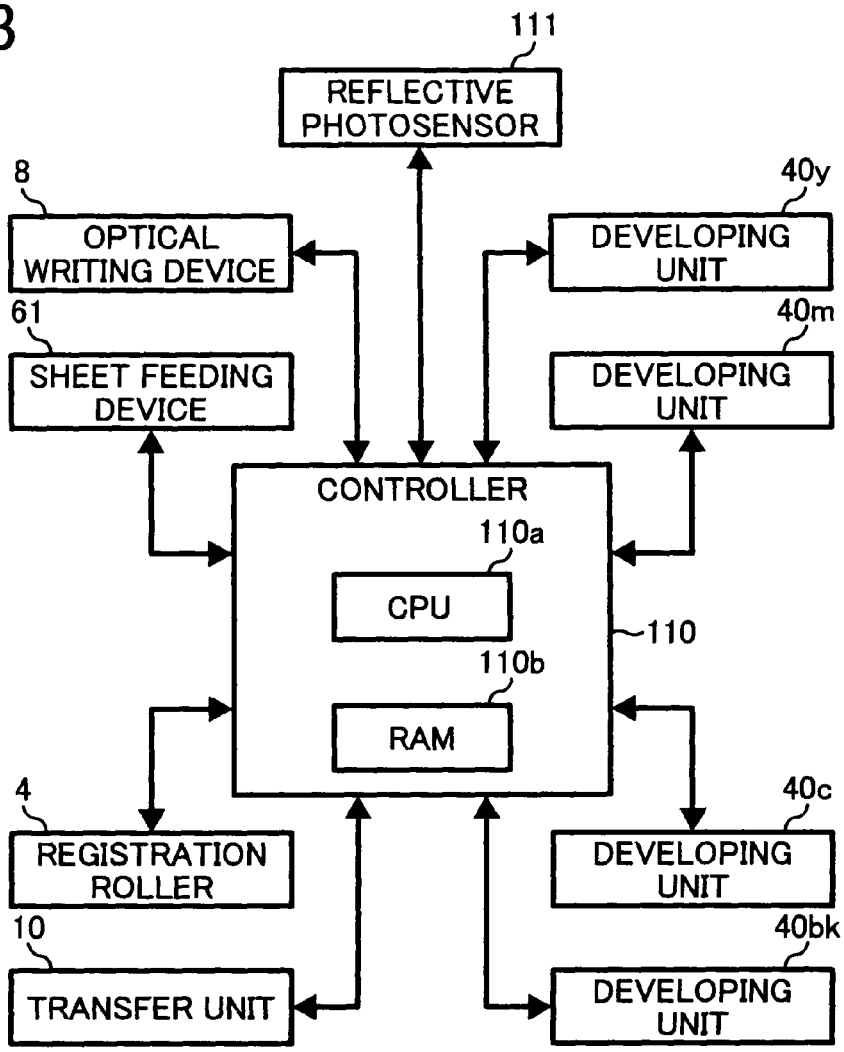
FIG. 3 is a block diagram showing a controller that controls an image density detection method performed in the image forming apparatus of FIG. 1.

Referring to FIG. 3, a block diagram of a controller 110 of the image forming apparatus 100 is described.

In FIG. 3, the controller 110 serves as a micro computer for controlling the image forming operations of the image forming apparatus 100. The controller 110 includes a central processing unit or CPU 110*a* and a random access memory or RAM 110*b*.

The CPU 110*a* executes and processes a sequence program of the image forming operations.

The RAM 110*b* includes a non-volatile memory for storing data.

The controller 110 is connected via an interface (not shown) to an input and output part or I/O part, which are the developing units 40*y*, 40*m*, 40*c*, and 40*bk* for developing toner images, the optical writing device 8, the sheet feeding device 61, the pair of registration rollers 4, the transfer belt unit 10, and the reflective light photosensor 111.

The reflective light photosensor 111 is disposed above the secondary backup roller 72 so that the sensor can output a signal according to the light reflectance from the intermediate transfer belt 11.

The reflective light photosensor 111 is disposed above the secondary backup roller 72 so as to output a signal according to the light reflectance from the intermediate transfer belt 11 (as shown in FIG. 1).

In the exemplary embodiment, a diffuse-type sensor is employed for the reflective light photosensor 111 to detect the high density area of color toners.

The structure of the reflective light photosensor 111 for detecting reference patterns is described later.

The controller 110 is configured to test image forming performance, including image density, of each developing unit 40 at a predetermined timing in the standby mode. The controller 110 tests the image forming performance, for example, when a main power source (not shown) is turned on, after a predetermined period of time has elapsed, or after a predetermined number of printed sheets has been output.

Specifically, when the above-described predetermined timing has come, the controller 110 causes the photoconductive drums 20*y*, 20*m*, 20*c*, and 20*bk* to rotate and the charging units 30*y*, 30*m*, 30*c*, and 30*bk* to uniformly be charged. For forming an image for reproduction, the surface of the photoconductive drum 20 is uniformly charged at the potential of −700V, for example. However, for testing the image forming performance, the controller 110 causes the potential to be gradually increased. Then, the laser light beam L emitted from the optical writing device 8 optically forms respective electrostatic latent images for respective reference patterns, and the developing units 40*y*, 40*m*, 40*c*, and 40*bk* develop the respective reference patterns.

Thus, bias development pattern images of different colors of toner, or respective patch patterns, are formed on the respective surfaces of the photoconductive drums 20*y*, 20*m*, 20*c*, and 20*bk*.

During the above-described developing operation, the controller 110 also controls to gradually, increase the developing bias value applied to the developing sleeve 40*a* (see FIG. 2) in each of the developing units 40*y*, 40*m*, 40*c*, and 40*bk*.

The respective reference patterns formed on the photoconductive drums 20*y*, 20*m*, 20*c*, and 20*bk* are sequentially transferred onto the surface of the intermediate transfer belt 11 at intervals of a predetermined gap therebetween. According to the above-described transferring operation, a pattern block serving as image data including the respective reference patterns are formed on the surface of the intermediate transfer belt 11.

Figure 4:
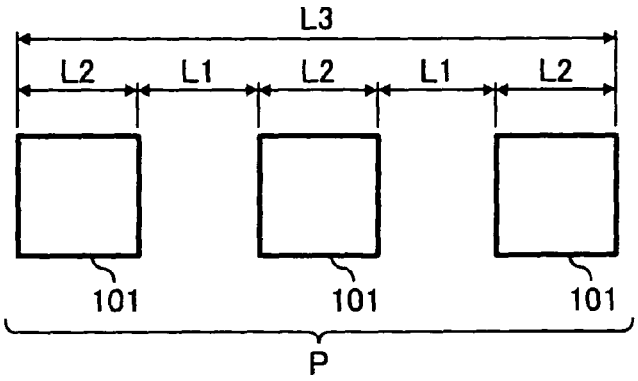
FIG. 4 is a schematic diagram of reference patterns.

FIG. 4 depicts a schematic structure of a reference pattern P.

The reference pattern P in FIG. 4 corresponds to any of reference patterns Py, Pm, Pc, and Pbk. The reference pattern P includes three reference images 101 arranged at intervals of 15 mm with respect to each other. The interval or length between the three reference images 101 is hereinafter referred to as a "length L1" or "L1."

In the image forming apparatus 100 according to the exemplary embodiment of the present invention, each reference image 101 has a square shape with the length of approximately 15 mm and the width of approximately 15 mm and has an interval of approximately 15 mm with its adjacent reference image 101. Therefore, each of the reference patterns Py, Pm, Pc, and Pbk on the intermediate transfer belt 11 has a length of approximately 75 mm. Hereinafter, the length of each reference image 101 is referred to as a "length L2" or "L2", and the length of each of the reference patterns Py, Pm, Pc, and Pbk are referred to as a "length L3" or "L3."

The reference patterns Py, Pm, Pc, and Pbk are transferred onto the surface of the intermediate transfer belt 11, not in an overlaid manner but in a lined up manner. This is different from the respective color toner images formed for the reproduction process. By transferring the reference patterns Py, Pm, Pc, and Pbk as described above, a patch pattern block PB including the reference patterns Py, Pm, Pc, and Pbk may be formed on the intermediate transfer belt 11.

Figure 5:
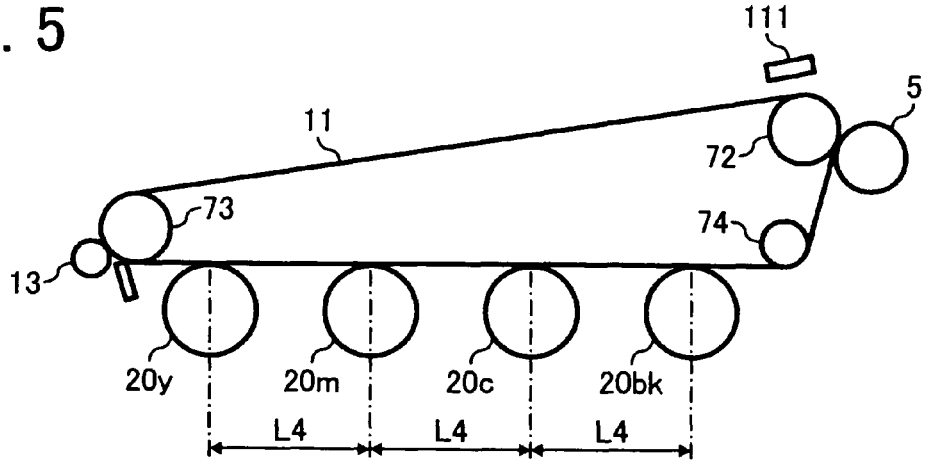
FIG. 5 is a schematic structure of a transfer mechanism in the image forming apparatus of FIG. 1.

Referring to FIG. 5, the arrangement of the photoconductive drums 20*y*, 20*m*, 20*c*, and 20*bk* with respect to the intermediate transfer belt 11 is described.

In FIG. 5, the photoconductive drums 20*y*, 20*m*, 20*c*, and 20*bk* are arranged in parallel with an extension direction of the intermediate transfer belt 11 so that the pattern block PB can be formed with the reference patterns Py, Pm, Pc, and Pbk being disposed with a predetermined setting pitch.

As shown in FIG. 5, a distance or length between adjacent drums 20*y*, 20*m*, 20*c*, and 20*bk* is set to approximately 100 mm. The length between the adjacent photoconductive drums of the photoconductive drum 20*y*, 20*m*, 20*c*, and 20*bk* is referred to as a "length L4" or "L4." Since each of the reference patterns Py, Pc, Pm, and Pbk have the length L3 of approximately 75 mm, an image forming pitch between the adjacent reference patterns is smaller than the setting pitch of the adjacent photoconductive drums, which corresponds to the length L4. With the above-described structure, the reference patterns Py, Pc, Pm, and Pbk can be transferred while the edges of the adjacent reference patterns are not overlaid.

Figure 6:
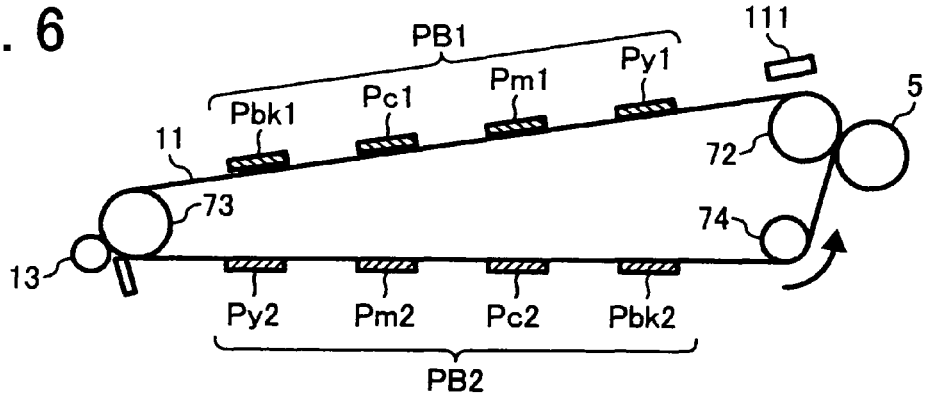
FIG. 6 is a schematic structure of the transfer mechanism of FIG. 5 with the reference patterns of FIG. 4.

Referring to FIG. 6, a schematic diagram of the intermediate transfer belt 11 of FIG. 5 with reference patterns is described.

In FIG. 6, the intermediate transfer belt 11 carries two reference patch pattern blocks PB1 and PB2 on the surface thereof. The reference patch pattern block PB1 includes reference patterns Py1, Pc1, Pm1, and Pbk1 and the reference patch pattern block PB2 includes reference patterns Py2, Pc2, Pm2, and Pbk2.

The reference patch pattern blocks PB1 and PB2 are formed as described below.

The reference patterns Pbk1, Pc1, Pm1, and Py1 of the reference patch pattern block PB1 are transferred onto the intermediate transfer belt 11 and keep moving until the reference patch pattern Py1 located at the most upstream side of the reference patch pattern block PB1 has passed through the transfer nip of the photoconductive drum 20*bk* located at the most downstream side in the moving direction of the intermediate transfer belt 11.

Then, the controller 110 causes the reference patterns Pbk2, Pc2, Pm2, and Py2 of the second reference patch pattern block PB2 to be formed, at a predetermined timing, on the respective surfaces of the photoconductive drums 20*y*, 20*m*, 20*c*, and 20*bk*. The predetermined timing is a timing to start transferring the reference patterns Pk2, Pc2, Pm2, and Py2 of the reference patch pattern block PB2 onto the surface of the intermediate transfer belt 11, after the first reference patch pattern block PB1 has passed the transfer nip of the photoconductive drum 20*bk* located at the most downstream side of the belt traveling direction and the trailing edge of the first reference patch pattern block PB1, which is the trailing edge of the reference pattern Py1, is further moved by a predetermined distance.

After the reference patterns Py1, Py2, Pm1, Pm2, Pc1, Pc2, Pbk1, and Pbk2 of the above-described pattern blocks PB1 and PB2 on the intermediate transfer belt 11 pass through the secondary transfer nip formed between the secondary transfer roller 5 and the secondary transfer backup roller 72 under the reflective light photosensor 111, the reflective light photosensor 111 disposed at the downstream side of the secondary transfer nip detects respective amounts of reflected light. The reflective light photosensor 111 converts the respective amounts of reflected light to corresponding electric signals and outputs the electric signals to the controller 110.

The controller 110 calculates light reflectance of each reference pattern based on the data sequentially output from the reflective light photosensor 111 and stores the results as the density pattern data into the RAM 110*b*.

The pattern blocks PB1 and PB2 that have passed under the reflective light photosensor 111 are removed or erased by the cleaning unit 13.

Figure 7:
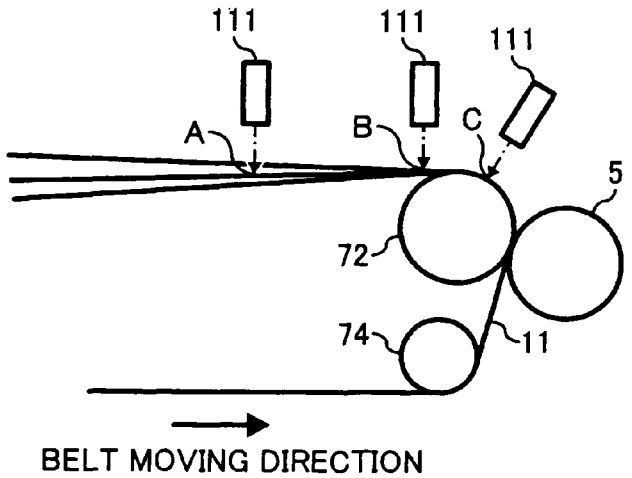
FIG. 7 is a schematic diagram of a reflective light photosensor at different positions.
Figure 8:
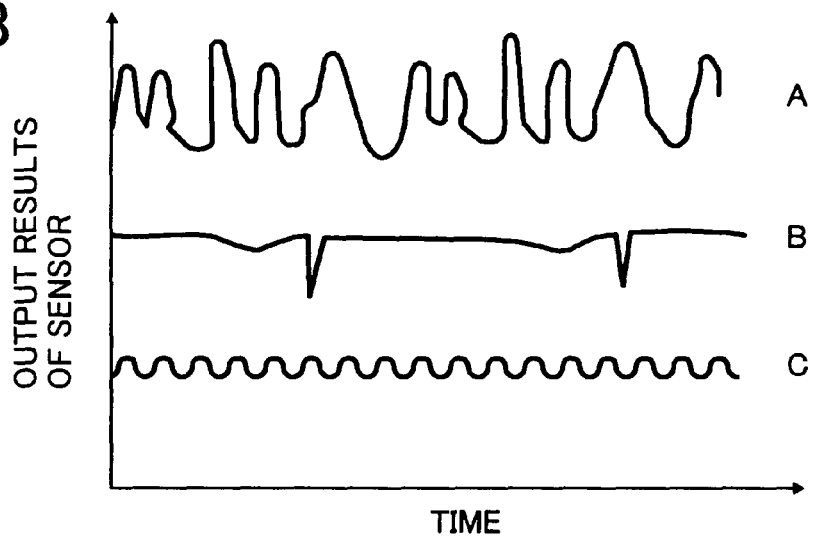
FIG. 8 is a timing chart showing output results of the reflective light photosensor of FIG. 7.

Now, referring to FIGS. 7 and 8, the positional effect of the reflective light photosensor 111 for the optical detection with respect to the intermediate transfer belt 11 is described.

FIG. 7 shows a variety of test positions of the reflective light photosensor 111, and FIG. 8 shows the output results of the reflective light photosensor 111 of FIG. 7.

In FIG. 7, the reflective light photosensor 111 was tentatively disposed at different positions with respect to detection areas A, B, and C corresponding to the respective different positions thereof to detect reference patterns on the surface of the intermediate transfer belt 11. The reflective light photosensor 111 used for the test had a focal length of 5.0 mm and the secondary backup roller 72 serving as the suspension roller of the intermediate transfer belt 11 had a diameter of 17.45 mm.

The output result of the reflective light photosensor 111 that detected reference patterns in the detection area A is shown in FIG. 8. Since the reflective light photosensor 111 was disposed far from the secondary backup roller 72 as shown in FIG. 7, the output signals were negatively affected by vibration of the intermediate transfer belt 11 in the vertical direction, and the output result became unstable.

When the reflective light photosensor 111 detected reference patterns in the detection area C, the variations of the output signals were smaller than the output result of the detection area A since the vertical vibration of the intermediate transfer belt 11 was reduced. However, the parallelism of the secondary backup roller 72 needs to be accurately adjusted; otherwise, the secondary backup roller 72 may become eccentric according to an increase of the number of rotations of the secondary backup roller 72. The axial eccentricity of the secondary backup roller 72 may exert an adverse effect to change the output signals of the reflective light photosensor 111. If a foreign material gets in between the intermediate transfer belt 11 and the secondary backup roller 72, a sharp peak may be output in the test result.

When the reflective light photosensor 111 detected reference patterns in the detection area B, the surface of the intermediate transfer belt 11 remained almost even or prevented roughness thereof because there was sufficient space to prevent foreign materials and the vibration of the intermediate transfer belt 11 was reduced by virtue of the secondary backup roller 72 disposed in the vicinity of the reflective light photosensor 111.

Figure 9:
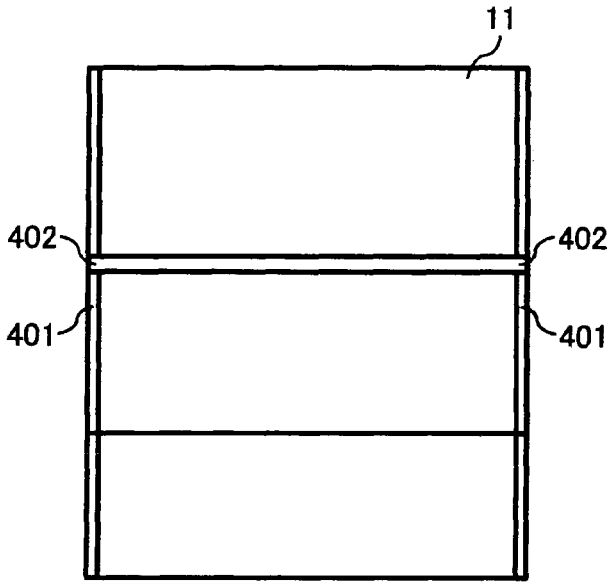
FIG. 9 is a plan view of an intermediate transfer belt of the transfer mechanism.
Figure 10:
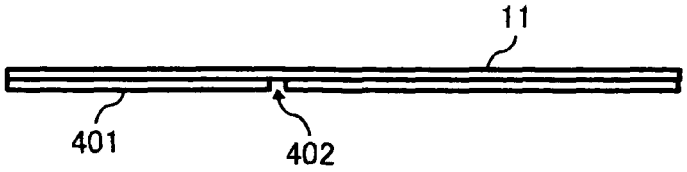
FIG. 10 is a side view of the intermediate transfer belt of FIG. 9.

However, a slippage prevention guide 401 shown in FIGS. 9 and 10 may be mounted on the intermediate transfer belt 11 to prevent the intermediate transfer belt 11 from slipping or moving over the secondary backup roller 72 in a horizontal direction. The slippage prevention guide 401 has a rail-shaped member and is mounted on both edges of the backside of the intermediate transfer belt 11.

There is a boundary gap 402 between the slippage prevention guides 401. Whenever the boundary gap 402 passes on the secondary backup roller 72, vibration may be generated on the intermediate transfer belt 11. Therefore, the output result of the reflective light photosensor 111 may generate a sharp peak by one cycle of the intermediate transfer belt 11.

Figure 11:
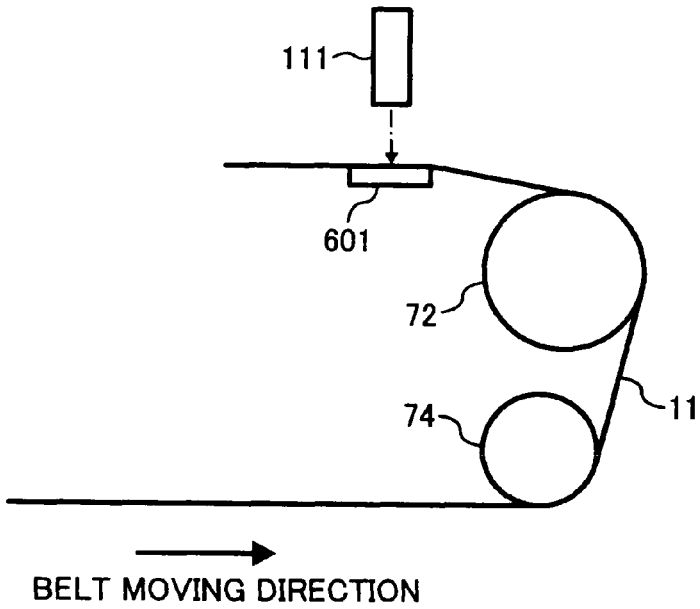
FIG. 11 is a schematic diagram of an image data detecting mechanism according to an example of the exemplary embodiment of the present invention.
Figure 12:
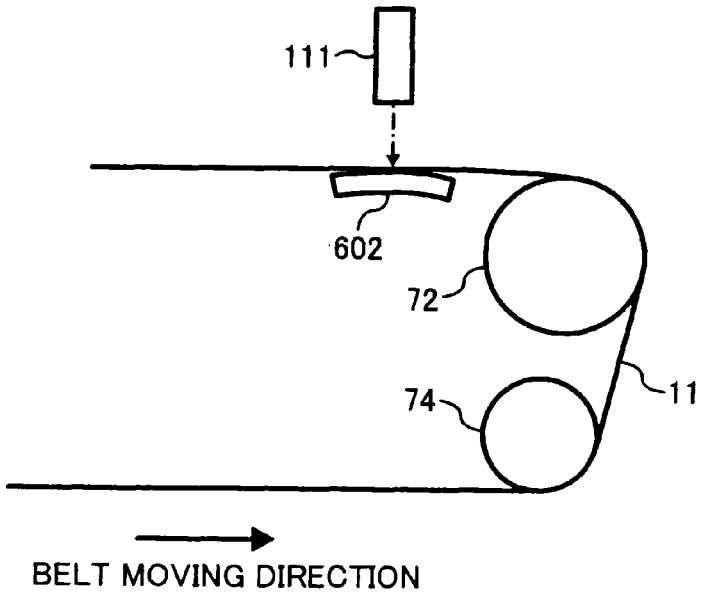
FIG. 12 is a schematic diagram of a different image data detecting mechanism according to a modified example of the exemplary embodiment of the present invention.

Referring to FIGS. 11 and 12, schematic structures of the intermediate transfer belt 11 provided with respective belt supporting members 601 and 602 are described, according to the exemplary embodiment of the present invention.

The belt supporting member 601 in FIG. 11 and the belt supporting member 602 in FIG. 12 are respectively disposed between the secondary backup roller 72 and the cleaning backup roller 73 (shown in FIG. 1). The reflective light photosensor 111 detects reference patterns in a detection area corresponding to a corresponding contact area of the intermediate transfer belt 11 and one of the belt supporting members 601 and 602. Specifically, the belt supporting members 601 and 602 are respectively arranged at respective positions in which the level of the tensioned surface of the intermediate transfer belt 11 is higher than the tangent line to the secondary backup roller 72 and the cleaning backup roller 73. The belt supporting members 601 and 602 function as a backing member with respect to the respective contact areas of the intermediate transfer belt 11 and the belt supporting members 601 or 602 to reduce or prevent vibration of the intermediate transfer belt 11. Therefore, variations of detection outputs of the reflective light photosensor 111 due to vibrations can be reduced or prevented, thereby obtaining the stable output results of the detection performed by the reflective light photosensor 111.

The surfaces of the belt supporting member 601 in FIG. 11 and the belt supporting member 602 in FIG. 12 are arranged to become substantially parallel with the intermediate transfer belt 11 in the belt moving direction. Thus, the above-described arrangement can reduce or prevent vibration likely to be caused when the belt moving direction is sharply changed. Specifically, the surface of the belt supporting member 601 in FIG. 11 has a planar shape and the surface of the belt supporting member 602 in FIG. 12 has a gently curled but almost planar shape. With the above-described respective shapes, the intermediate transfer belt 11 can smoothly be rotated and the vibration that may be caused when the intermediate transfer belt 11 is moving can be reduced.

In this exemplary embodiment, the intermediate transfer belt 11 includes one of the belt supporting members 601 and 602. However, the number of belt supporting members is not limited. For example, a plurality of belt supporting members can be mounted in the belt moving direction.

Figure 13:
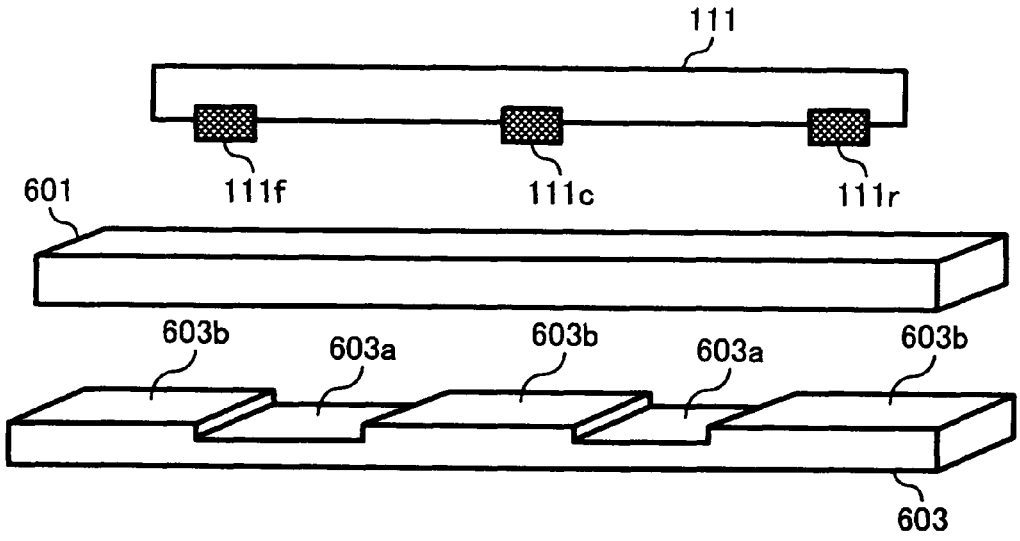
FIG. 13 is a schematic structure of a belt supporting member according to the exemplary embodiment of the present invention.

Referring to FIG. 13, a modified example of the belt supporting member 601 of FIG. 11, according to the exemplary embodiment of the present invention, is described.

In FIG. 13, a belt supporting member 603 is provided with respect to the belt supporting member 601 to absorb the belt vibration transmitted via the belt supporting member 601.

The belt supporting member 603 includes grooved portions 603*a* having a height of 0.5 mm on a surface thereof. The grooved portions 603*a* are arranged to take up areas out of the detection areas for sensing portions 111*f*, 111*c*, and 111*r* of the reflective light photosensor 111. The sensor portions 111*f*, 111*c*, and 111*r* are arranged at the front, center, and rear portions of the reflective light photosensor 111, respectively, in the width direction of the reflective light photosensor 111. The reflective light photosensor 111 determines the average detection result based on the detection results of the sensing portions 111*f*, 111*c*, and 111*r* so that intolerable variation can be prevented. The portions other than the grooved portions 603*a* correspond rectangular-shaped contact surfaces 603*b* in the belt width direction and are arranged to contact with the surface of the belt supporting member 601.

With the above-described structure having the belt supporting member 603, vibration in the belt width direction is collected to the grooved portions 603*a*, which may reduce the vibration of the contact surfaces 603*b*. Thereby, variations of the optical path lengths of the sensing portions 111*f*, 111*c*, and 111*r* of the reflective light photosensor 111 can effectively be reduced or prevented.

Figure 14:
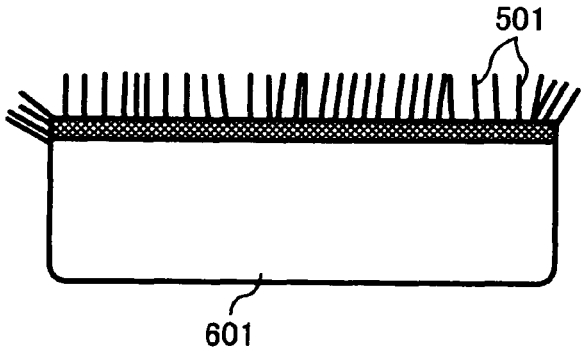
FIG. 14 is a schematic structure of a modified belt supporting member according to the exemplary embodiment of the present invention.

Referring to FIG. 14, a different modified example of the belt supporting member 601 according to the exemplary embodiment of the present invention is described.

In FIG. 14, the belt supporting member 601 is provided with a brush 501 on the surface thereof so as to reduce the frictional coefficient on the surface of the belt supporting member 601 held in contact with the intermediate transfer belt 11. The above-described structure is not limited to the belt supporting member 601 but can be applied to the belt supporting member 602 or other different belt supporting members according to the exemplary embodiment of the present invention.

When the intermediate transfer belt 11 moves on the surface of the belt supporting member 601, frictional resistance may be generated between the intermediate transfer belt 11 and the belt supporting member 601. Due to the frictional resistance, it is likely that the durability of the intermediate transfer belt 11 is deteriorated.

When the belt supporting member 601 is provided with the brush 501 or a brush-shaped member, as shown in FIG. 14, the coefficient of frictional resistance of the surface of the belt supporting member 601 contacting with the intermediate transfer belt 11 can be reduced and the vibration of the intermediate transfer belt 11 can be absorbed.

The brush 501 can be adhered onto the surface of the belt supporting member 601 with a double stick tape or other adhesive agent. The brush 501 has rigidity to reduce vibration or undulating of the intermediate transfer belt 11 and so forth.

Therefore, the belt supporting member 601 with the brush 501 can reduce the frictional resistance of the belt supporting member 601 with respect to the intermediate transfer belt 11, and further reduce or prevent the durability deterioration due to a crack on the intermediate transfer belt 11 and noise during the travel of the intermediate transfer belt 11.

As previously described, the surface of the belt supporting member 601 is planar and the surface of the belt supporting member 602 is gently curled but almost planar. Further, the belt supporting members 601 and 602 are respectively arranged to contact with the intermediate transfer belt 11 in parallel, at a position higher than the tangent line of the secondary backup roller 72 and the cleaning backup roller 73. With the above-described structure, a certain angle may be generated between the intermediate transfer belt 11 and each of the belt supporting members 601 and 602, at the respective downstream edges of the belt supporting members 601 and 602, when the intermediate transfer belt 11 contacts the respective edges of the belt supporting members 601 and 602.

Figure 15:
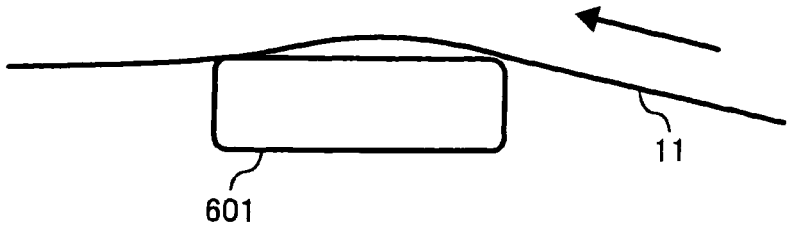
FIG. 15 is a schematic diagram of the intermediate transfer belt and the belt supporting member.

FIG. 15 depicts the intermediate transfer belt 11 and the belt supporting member 601 in the above-described condition.

As shown in FIG. 15, the contact surface of the intermediate transfer belt 11 with respect to the belt supporting member 601 is gently curved or bowed toward an upward direction and becomes separated from the belt supporting member 601 to form a non-contact area of the intermediate transfer belt 11 with respect to the belt supporting member 601. The non-contact area may vibrate or undulate the intermediate transfer belt 11 in the vertical direction. That is, when the intermediate transfer belt 11 travels on each of the belt supporting members 601 and 602 that are arranged higher than the tangent line of the suspension rollers, the surface of the intermediate transfer belt 11 can easily be vibrated or undulated.

Figure 16:
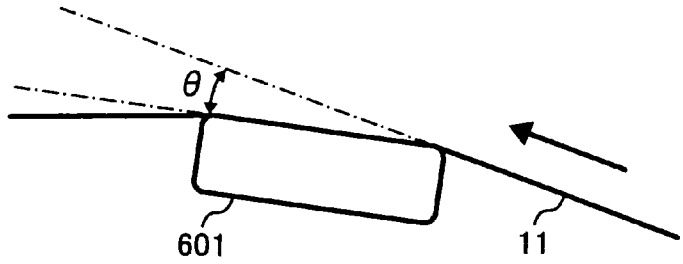
FIG. 16 is a schematic diagram of the intermediate transfer belt and the belt supporting member according to the exemplary embodiment of the present invention.

To eliminate the above-described condition, the belt supporting member 601 can be disposed with a predetermined angle, based on the surface of the intermediate transfer belt 11 serving as a reference surface, as shown in FIG. 16. As described above, it should be noted that the above-described structure is not limited to the belt supporting member 601 but can be applied to the belt supporting member 602 or different belt supporting members according to the exemplary embodiment of the present invention.

In FIG. 16, the belt supporting member 601 is arranged to tilt to the downstream side thereof in the upward direction such that a difference between an approach angle of the intermediate transfer belt 11 with respect to the belt supporting member 601 and a tilt angle of the belt supporting member 601 falls in a range of angle from approximately 0.5 degrees to approximately 10 degrees, which has been obtained based on experimental results.

With the above-described structure, the intermediate transfer belt 11 can contact with the center portion of the belt supporting member 601 and the vibration of the intermediate transfer belt 11 in a vertical direction can be reduced or prevented.

In the exemplary embodiment of the present invention, the approach angle of the intermediate transfer belt 11 to the belt supporting member 601 is set to approximately 6 degrees and the tilt angle of the belt supporting member 601 is set to approximately 2 degrees. Thereby, an angle θ is determined to be set to approximately 4 degrees.

Further, in the exemplary embodiment, a mounting angle of the reflective light photosensor 111 can be adjusted according to the angle θ formed between the belt supporting member 601 and the intermediate transfer belt 11. With the above-described adjustment, the reflective light photosensor 111 can detect the reference patterns while maintaining an ideal mounting angle against the flap angle characteristic of the reflective light photosensor 111. For example, the reflective light photosensor 111 can be disposed to detect a detection area in a normal direction with respect to the intermediate transfer belt 11 or the center portion of the belt supporting member 601, so that the light reflected by the surface of the intermediate transfer belt 11 can properly be detected.

Figure 17:
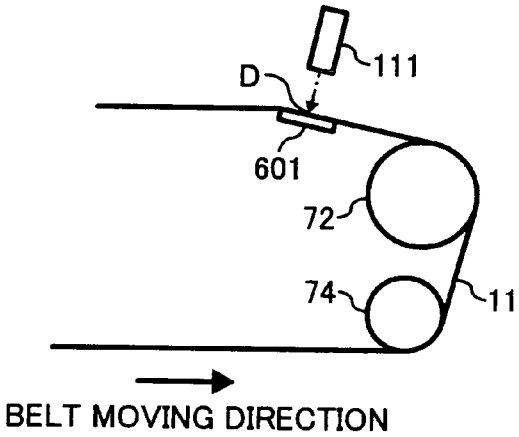
FIG. 17 is a schematic diagram of the reflective light photosensor according to the exemplary embodiment of the present invention.
Figure 18:
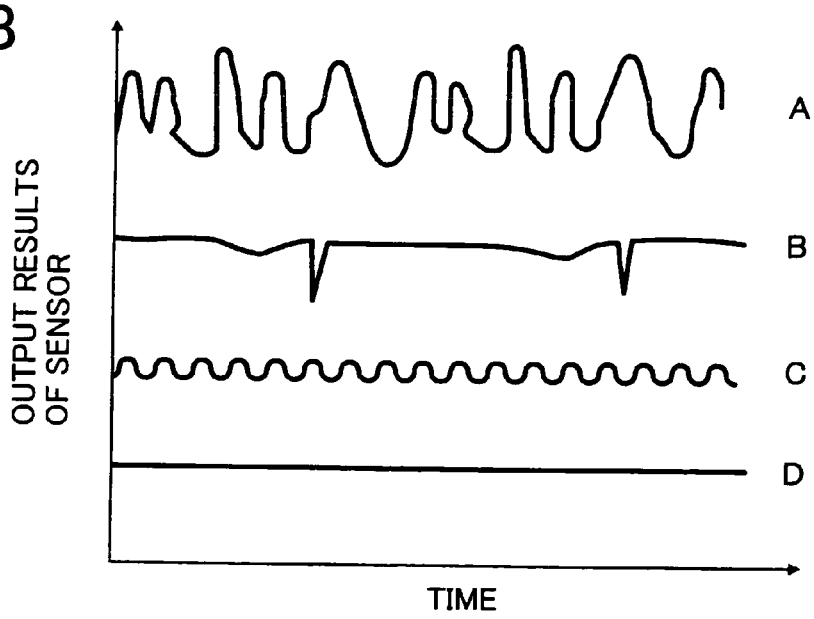
FIG. 18 is a timing chart showing output results of the reflective light photosensor of FIG. 17.

Referring to FIGS. 17 and 18, the optical detection of the reflective light photosensor 111 according to the exemplary embodiment of the present invention is described.

The belt supporting member 601 having the brush 501 (see FIG. 14) on the surface thereof is disposed to have the angle θ (see FIG. 16) of approximately 4 degrees as shown in FIG. 17. The reflective light photosensor 111 is disposed to have a lean of 2 degrees according to the tilt of the belt supporting member 601. With the above-described arrangement, the reflective light photosensor 111 detected a detection area D shown in FIG. 17. Consequently, the output results were obtained as shown in a graph of FIG. 18. As can be seen from the output results of FIG. 18, the output result of the detection area D of the reflective light photosensor 111 could reduce the output vibration to the minimum, compared with the output results of the detection areas A, B, and C.

As described above, the reference pattern P according to image data can be detected with an appropriate focal length or an accurate optical path length corresponding to a vertex distance between the reflective light photosensor 111 and the intermediate transfer belt 11, by preventing variations of the optical path length caused by vibration of the intermediate transfer belt 11.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Obviously, numerous modifications and variations of the present invention are possible in light of the above teachings. It is therefore to be understood that within the scope of the appended claims, the invention may be practiced otherwise than as specifically described herein.

What is as new and desired to be secured by letters patent of the United States claimed is:

1. An image forming apparatus, comprising:

a belt member supported by at least two rollers, and one of the at least two rollers forms a secondary transfer nip with a secondary transfer roller;

an image forming member configured to form a patch pattern of image data on a surface of the belt member;

a belt supporting member configured to support the belt member on a contact area thereof with respect to the belt member at a position higher than a tangent line of the at least two rollers, and the belt supporting member is positioned downstream, in a moving direction of the belt member, of the one of the at least two rollers that forms the secondary transfer nip; and a sensor configured to detect the patch pattern formed on the surface of the belt member at the contact area of the belt supporting member and the belt member.

2. The image forming apparatus according to claim 1, wherein:

the belt supporting member has a planar shape.

3. The image forming apparatus according to claim 1, wherein:

the belt supporting member has a planar shape and includes at least one rectangular contact surface in a belt width direction.

4. The image forming apparatus according to claim 3, wherein:

the at least one rectangular contact surface is disposed at a position facing the sensor.

5. The image forming apparatus according to claim 1, wherein:

the belt supporting member has a substantially planar shape with a gentle curl.

6. The image forming apparatus according to claim 1, wherein:

the belt supporting member has a substantially planar shape with a gentle curl and includes at least one rectangular contact surface in a belt width direction.

7. The image forming apparatus according to claim 6, wherein:

the at least one rectangular contact surface is disposed at a position facing the sensor.

8. The image forming apparatus according to claim 1, wherein:

the belt supporting member includes a brush on a surface thereof.

9. The image forming apparatus according to claim 1, wherein:

the belt supporting member is arranged to tilt to a downstream side thereof in an upward direction such that a difference between an approach angle of the belt member with respect to the belt supporting member and a tilt angle of the belt supporting member falls in a range of angle from approximately 0.5 degrees to approximately 10 degrees, based on the surface of the belt member as a reference surface.

10. The image forming apparatus according to claim 9, wherein:

the sensor has a mounting angle to be adjusted according to the tilt angle of the belt supporting member.

11. The image forming apparatus according to claim 1, further comprising:

a controller configured to test image forming performance based on data output from the sensor.

12. The image forming apparatus according to claim 1, wherein:

the image forming member includes at least two photoconductive drums configured to form respective patch patterns of image data on the surface of the belt member.

13. The image forming apparatus according to claim 12, wherein:

the respective patch patterns are sequentially transferred onto the surface of the belt member at predetermined intervals to form a pattern block.

14. The image forming apparatus according to claim 1, wherein:

the belt member includes a slippage guide to prevent slipping by the belt member.

15. A method of detecting image data with a focal length of a sensor of an image forming apparatus, comprising:

supporting a belt member with at least two rollers in a tensioned manner, and one of the at least two rollers forms a secondary transfer nip with a secondary transfer roller;

mounting a belt supporting member on a contact area with respect to the belt member at a position higher than a tangent line of the at least two rollers, and the belt supporting member is positioned downstream, in a moving direction of the belt member, of the one of the at least two rollers that forms the secondary transfer nip; and detecting a patch pattern formed on the belt member at the contact area of the belt supporting member and the belt member.

16. The method of detecting image data according to claim 15, further comprising:

tilting the belt supporting member to a downstream side thereof in an upward direction such that a difference between an approach angle of the belt member with respect to the belt supporting member and a tilt angle of the belt supporting member falls in a range of angle from approximately 0.5 degrees to approximately 10 degrees, based on a surface of the belt member as a reference surface.

17. The method of detecting image data according to claim 16, further comprising:

adjusting a mounting angle of the sensor according to the tilt angle of the belt supporting member.

18. An image forming apparatus, comprising:

a belt member supported by at least two rollers, and one of the at least two rollers forms a secondary transfer nip with a secondary transfer roller;

an image forming member configured to form a patch pattern of image data on a surface of the belt member;

a means for supporting the belt member on a contact area thereof with respect to the belt member at a position higher than a tangent line of the at least two rollers, and the means for supporting the belt member is positioned downstream, in a moving direction of the belt member, of the one of the at least two rollers that forms the secondary transfer nip; and a sensor configured to detect the patch pattern formed on the surface of the belt member at the contact area of the belt member and the means for supporting the belt member.

19. The image forming apparatus according to claim 18, further comprising:

a controlling means for testing image forming performance based on data output from the sensor.

20. The image forming apparatus according to claim 18, wherein:

the image forming member includes at least two photoconductive drums configured to form respective patch patterns of image data on the surface of the belt member.

21. The image forming apparatus according to claim 18, wherein:

the means for supporting the belt member is arranged to tilt to a downstream side thereof in an upward direction such that a difference between an approach angle of the belt member with respect to the means for supporting the belt member and a tilt angle of the means for supporting the belt member falls in a range of angle from approximately 0.5 degrees to approximately 10 degrees, based on the surface of the belt member as a reference surface.

* * * * *